US006334549B1

(12) United States Patent
Fernández et al.

(10) Patent No.: US 6,334,549 B1
(45) Date of Patent: Jan. 1, 2002

(54) FLUID PUMP DISPENSER HAVING PRODUCT RETRACTION FEATURE

(75) Inventors: Xavier González Fernández; Pedro Parés Montaner; Victor Ribera Turró, all of Barcelona (ES)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/809,040

(22) Filed: Mar. 16, 2001

(51) Int. Cl.[7] ..... F04B 53/12
(52) U.S. Cl. ..... 222/153.13; 222/321.9
(58) Field of Search ..... 222/153.13, 321.9, 222/321.3

(56) References Cited

U.S. PATENT DOCUMENTS

| | | | |
|---|---|---|---|
| 3,187,960 A | | 6/1965 | Gorman |
| 3,489,322 A | | 1/1970 | Ayres |
| 3,500,761 A | | 3/1970 | Clevenger et al. |
| 3,608,788 A | | 9/1971 | Tanaka |
| 3,724,726 A | | 4/1973 | Susuki et al. |
| 4,155,489 A | | 5/1979 | Steiman |
| 4,162,746 A | | 7/1979 | Anderson et al. |
| 4,434,916 A | | 3/1984 | Ruscitti et al. |
| 4,991,746 A | | 2/1991 | Schultz |
| 5,405,057 A | | 4/1995 | Moore |
| 5,615,806 A | | 4/1997 | Grothoff |
| 6,045,008 A | * | 4/2000 | Fernandez et al. ..... 222/153.13 |

* cited by examiner

*Primary Examiner*—Philippe Derakshani
(74) *Attorney, Agent, or Firm*—Dykema Gossett PLLC

(57) ABSTRACT

A fluid pump dispenser of the loss motion piston type provides for maintaining the discharge open a slight interval at the commencement of each plunger upstroke while the pump chamber expands to retract product from the discharge passage into the chamber to thereby avoid the formation of product droplets at the exit end of the discharge. Such is effected in accordance with one embodiment by reducing the friction force acting between the piston and the pump cylinder relative to the friction force acting between the piston and the stem. In another embodiment an inlet valve assembly has a portion lying in the path of the piston which portion is connected by spring legs to a valve portion such that the restoring force of the spring legs shifts the piston together with the stem at the commencement of the plunger upstroke which maintains the discharge passage in open communication with the chamber.

10 Claims, 3 Drawing Sheets

FLUID PUMP DISPENSER HAVING PRODUCT RETRACTION FEATURE

RELATED APPLICATION

This application relates to U.S. application Ser. No. 09/271,239, filed Mar. 17, 1999, and commonly owned herewith now U.S. Pat. No. 6,045,008.

BACKGROUND OF THE INVENTION

This invention relates generally to a manually operated fluid pump dispenser having a hollow piston mounted on a hollow stem for relative sliding movement during piston reciprocation within the pump cylinder to open and close the discharge through the stem. More particularly, the present invention provides for the retraction of product into the pump chamber at the commencement of each piston return stroke to avoid the formation of any dribbles or drips of product at the discharge opening. The product retraction feature is effected by a modification of the pump cylinder without the need for any additional parts, thereby producing significant savings in assembly operation and capital costs involved in producing the dispenser.

As described in the aforementioned related application, the annular piston having a central bore is mounted on the hollow stem of the pump plunger for reciprocation within the pump cylinder which defines together with the pump piston a variable volume pump chamber. A valve controlled inlet passage leads into the chamber, and a valve controlled discharge passage defined by the hollow stem and terminating in a discharge exit opening, leads away from the pump chamber. The piston is mounted on the stem for relative sliding movement during pumping to open and close the discharge port leading to the discharge passage.

The friction force acting between the piston and the inner wall of the pump cylinder is typically greater than the friction force existing between the bore wall of the annular piston and the confronting outer wall of the plunger stem. Thus, during each pressure stroke as the operator depresses the plunger against the force of a return spring, the plunger stem, by reason of such difference in friction forces, shifts in advance of the piston a given distance as determined by engaging stops acting between the piston and the stem.

At the commencement of the piston return stroke, because of the higher friction force acting between the piston and the cylinder versus the friction force acting between the piston and the stem, the plunger stem shifts upwardly under the action of the biasing force of the return spring in advance of movement of the piston to thereby close the discharge port as the piston engages a valve element on the lower end of the stem, thus raising the piston during the return stroke together with the plunger and its stem. The shifting piston during its return stroke thus expands the volume of the pump chamber which reduces the internal pressure below atmospheric and induces product to be drawn from the inlet passage via an unseated check valve and into the pump chamber to reprime the pump. During the pump chamber repriming operation, the discharge valve remains closed while the inlet valve is open.

SUMMARY OF THE INVENTION

An object of the present invention is to improve upon the manual pump dispenser of the type aforedescribed as having a relatively shifting annular piston which during pressure and suction strokes opens and closes a discharge port leading to a discharge opening through the stem. In accordance with the invention, a product retraction feature has been developed by a unique modification of the pump bore to effect product retraction into the pump chamber to avoid the formation of any droplets of product at the discharge exit opening. The provision of such a feature requires no additional parts, but simply a restructuring of an existing part thereby avoiding any increase in overall cost of the dispenser. Adaptation of the pump dispenser in accordance with the invention for product retraction is a simple and straightforward procedure yet highly effective and economical.

Pursuant to the invention, the annular piston at the beginning of each piston return stroke initially shifts outwardly of the pump bore together with the plunger stem thereby maintaining the discharge port open such that the discharge passage remains in communication with the now expanding pump chamber causing a pressure drop therein. This reduction in pressure while the discharge remains open a short interval retracts product from the discharge passage into the expanding pump chamber to thereby avoid the unsightly and unwanted bubble/dribble formation of product at the exit end of the discharge passage.

According to the invention, the interference fit between the piston and the pump cylinder wall is adjusted at the lower end of the cylinder for decreasing the friction force acting therebetween below that of the friction force existing between the wall of the central bore of the annular piston and the surrounded plunger stem. This enables the stem to shift the piston together therewith at the commencement of the plunger return stroke thereby maintaining the discharge in an open position during a short interval of the piston return. As the discharge passage remains in open communication with the expanding pump chamber, the negative pressure created by the expanding chamber pulls product from the discharge passage into the chamber while at the same time starts to pull product into the chamber through the inlet passage. The effect is a withdrawal of product inwardly away from the exit end of the discharge path.

In accordance with another embodiment of the invention, the inlet valve has a restoring spring means biased in the direction of reciprocation and lying in the path of reciprocation of the piston. Thus at the end of each pressure stroke, the piston impacts against the spring means causing the piston to shift together with the plunger stem during the ensuing return stroke thus retaining the discharge open and in communication with the expanding pump chamber during a short interval. The negative pressure thus created by the expanding pump chamber functions to draw product into the pump chamber from the discharge passage and to draw product into the pump chamber through the inlet passage. The product is thus retracted away from the terminal end of the discharge to avoid the formation of any dribbles or drips thereat.

Other objects, advantages and novel features of the invention will become more apparent from the following detailed description of the invention when taken in conjunction with the accompany drawings.

DETAILED DESCRIPTION OF THE INVENTION

Figure 1:
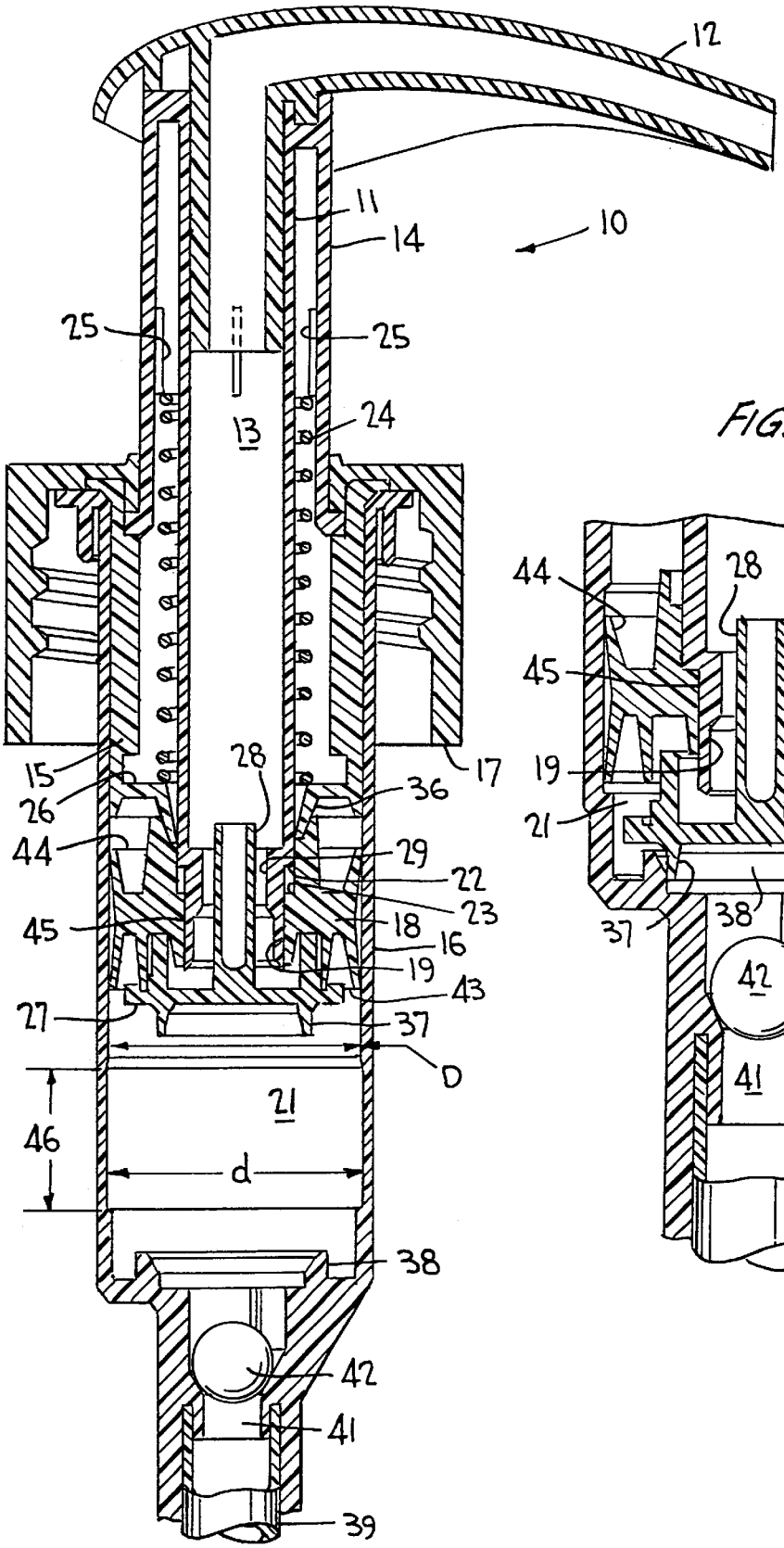
FIG. 1 is a vertical sectional view of the fluid pump dispenser incorporating one embodiment according to the invention.

Turning now to the drawings wherein like reference characters refer to like and corresponding parts throughout the several views, a fluid dispenser in accordance with one embodiment of the invention is generally designated 10 in FIG. 1, similar to that disclosed in the aforementioned U.S. patent application Ser. No. 09/217,239 now U.S. Pat. No. 6,045,008 as including a pump plunger having an elongated hollow plunger stem 11 with a discharge spout 12 at its upper end and defining a discharge passage 13. A surrounding skirt 14 is designed to engage and disengage in inner liner 15 fixed within the upper end of a pump body defining a pump cylinder 16 to which an internally threaded closure cap 17 is mounted for mounting the dispenser to a container (not shown) of product to be dispensed. The plunger is shown in an up-lock position in FIG. 1 and is capable of being locked in a plunger lock down position as described in detailed in the aforementioned application. The present invention is likewise adapted to be incorporated within a dispenser without such a plunger lock-up or lock-down feature, without departing from the scope of the invention.

A hollow annular piston 18 having a central bore 19 is mounted at a lower end of the plunger stem for reciprocation together with the plunger within the pump cylinder to therewith define a variable volume pump chamber 21. The piston is likewise mounted on the plunger stem for relative sliding movement during manual reciprocation. For this purpose the inner end section of the stem is constricted presenting a shoulder 22 which in the fully raised position of the plunger shown in FIG. 1 is spaced from a confronting inner shoulder 23 formed on the piston. A plunger return spring 24 extends between suitable ribs 25 or the like on the inner surface of plunger skirt 14 and an inner flange 26 of liner 15, for spring biasing the piston into its at rest position of FIG. 1.

A valve element 27 is fixed to the inner end of the plunger stem, element 27 having a pair of upstanding legs 28 press fitted or otherwise secured within central bore 29 at the constricted end of the plunger stem to establish unobstructed ports 33 as shown to the lower terminal end of the stem.

Valve element 27 is provided with an upwardly open annular groove 31 (FIG. 2) defining a valve seat for the reception of an annular valve flange 32 depending from the piston.

In the at rest and/or up-lock position of the plunger, communication between pump chamber 21 and discharge passage 13 is valved closed due to sealing engagement between valve flange 32 and valve seat 31, such that discharge ports 33 remain closed. Also an upstanding annular flange 34 on the piston has an open annular groove 35 for the reception of an annular seal 36 depending from inner flange 26 of liner 15. Any leakage of product from the pump chamber in the FIG. 1 condition is thereby avoided.

Figure 2:
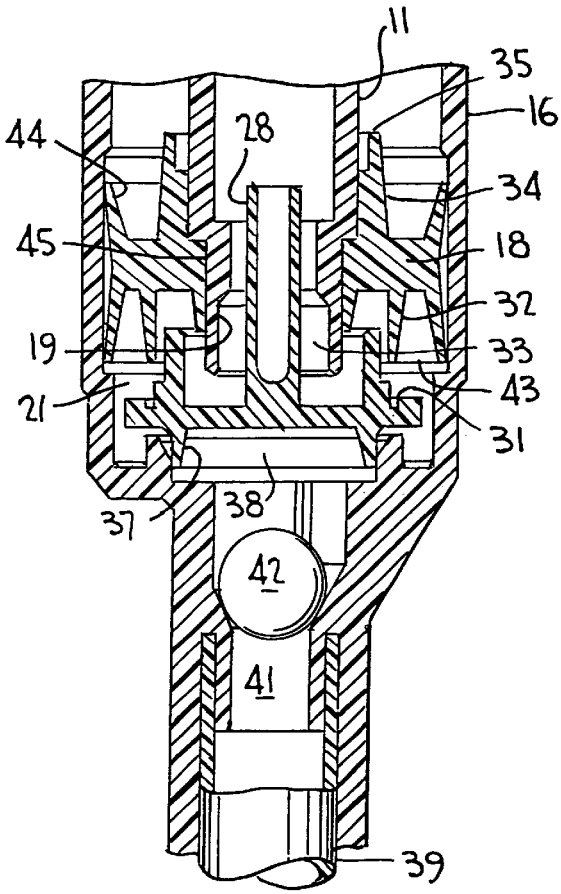
FIG. 2 is a view similar to FIG. 1 showing the plunger stem and piston at the end of the downstroke.

In a lock down position of the plunger as well as in the end of the plunger down stroke as shown in FIG. 2, the depending annular flange 37 on element 27 sealingly engages within upstanding flange 38 at the bottom end of the pump cylinder. And depending from the bottom end of the cylinder is a typical dip tube 39 which extends into the container (not shown) to which the dispenser is mounted and defines an inlet passage 41 into the pump chamber controlled by an inlet ball check valve 42 or the like.

In operation, with the plunger unlocked from its up position of FIG. 1, downward manual pressure applied against the plunger shifts stem 11 relative to piston 18 initially until shoulders 22 and 23 contact thus effecting the shifting of valve element 27 away from valve flange 32 to open discharge ports 33. Continued downward pressure applied against the plunger serves to reciprocate the piston within the cylinder for pressurizing product during plunger reciprocation located in the pump chamber, and discharging the same from the end of spout 12 through the discharge passage. During each ensuing upstroke of the plunger as effected by the restoring force of the return spring, the pump chamber expands and a negative pressure therein created causes product to be drawn into the pump chamber via the open inlet passage. A ball cage may be provided within the throat of the pump cylinder for limiting movement of the ball valve from its seat, as in any normal manner.

The "lost motion" provided between the plunger and the piston during the pressure and return strokes typically allows for the return of the stem from the end of the plunger downstroke in advance of the piston to thereby cause valve flange 32 to reseat against valve groove 31 thereby closing the discharge ports and effecting piston return together with plunger to the FIG. 1 position. During plunger reciprocation between the pressure and return strokes as aforedescribed droplets of product oftentimes form at the discharge end of the spout at the end of the plunger downstroke before the discharge ports are closed. This droplet formation is problematic as it presents an undesirable condition for the operator.

According to the invention, discharge ports 33 are caused to remain open for a short interval at the beginning of the plunger return stroke while the pump chamber expands such that the open communication between the sub-atmospheric condition of the expanding pump chamber and the discharge passage causes a small amount of product to be retracted from the discharge passage into the pump chamber before the discharge ports close. Such a retraction causes product to be suctioned inwardly of the discharge end of the spout, thereby preventing the formation of product droplets at the spout at the end of the plunger downstroke as before.

During the plunger downstroke, the friction force acting between piston seals 43, 44 and the inner wall of the pump cylinder is greater than the friction force acting between the wall of central bore 19 of the piston and outer wall 45 of the constricted section of the plunger stem. This enables the stem during the plunger downstroke to shift relative to the piston as determined by stops 22, 23. And, at the commencement of the plunger upstroke, greater friction force is exhibited between the piston seals and the pump cylinder wall compared to that exhibited between 19 and 45 which causes the reverse movement, i.e., a plunger return slightly in advance of the piston return to thereby close the discharge.

In accordance with one embodiment of the invention shown in FIGS. 1 to 4, inner diameter d of the pump cylinder, at a lowermost section 46 thereof, is slightly greater than the standard inner diameter D of the pump cylinder for the remainder thereof. The inner diameter d is sized as not to affect the sealability between 43, 44 and pump cylinder inner wall, at the end of the piston downstroke as shown in FIG. 2, but is sized nevertheless to reduce the friction force acting between 43, 44 and the cylinder inner wall, such that the reduced friction force is less than that existing between outer wall 45 and the wall of central bore 19 of the piston.

Figure 3:
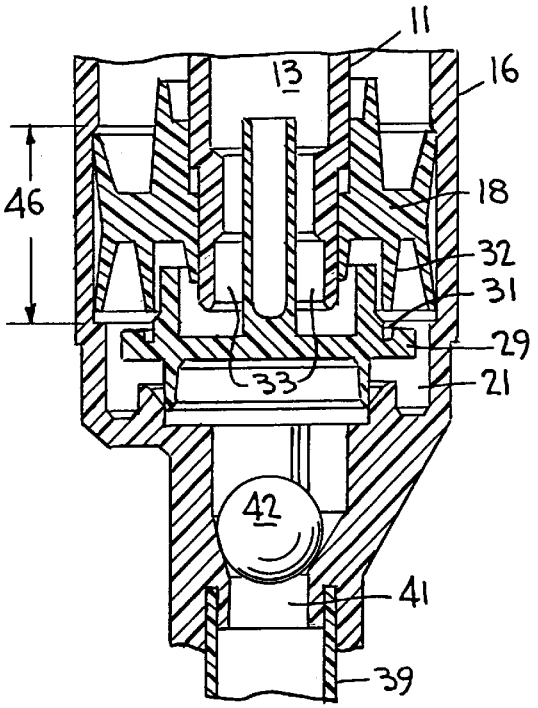
FIG. 3 is a view similar to FIG. 2 showing the piston and stem after the commencement of the upstroke.
Figure 4:
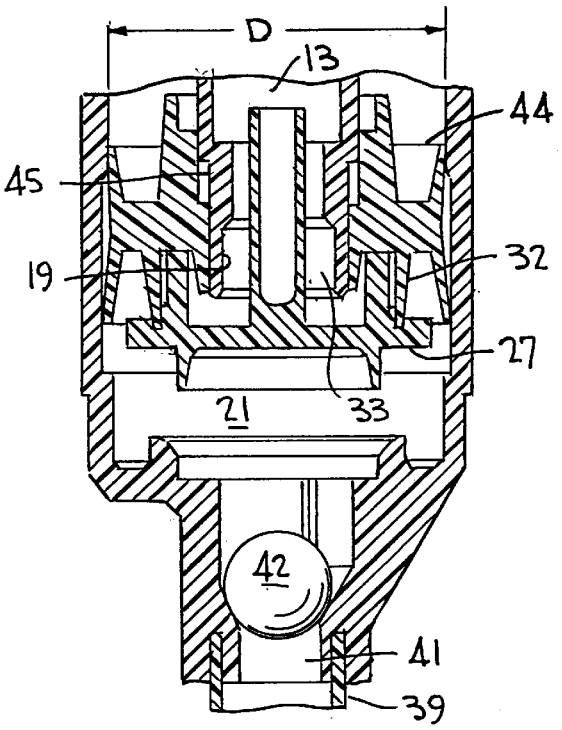
FIG. 4 is a view similar to FIG. 2 showing the piston and stem during upward travel after upstroke commences.

This variable interference established between the piston and the inner wall of the pump cylinder facilitates return movement of the piston together with the stem at the commencement of the plunger upstroke from the FIG. 2 to the FIG. 3 positions. The greater friction force established between 45, 19 which exceeds that established between seals 43, 44 and the inner wall of the pump cylinder at section 46 permits the piston to be returned momentarily together with the plunger return while discharge ports 33 remain open to thereby maintain open communication between pump chamber 21 and discharge passage 13. This discharge open condition established during pump chamber expansion permits a small amount of product to be retracted from the discharge passage into the pump chamber to thereby avoid droplet formation at the end of the discharge spout, while at the same time the expanding pump chamber volume commences suctioning of product from the inlet passage via the unseated inlet ball check valve. When plunger seal 44 reaches the inner diameter D section of the cylinder, as shown in FIG. 4, the greater friction force between seal 44 and that inner wall portion of the cylinder compared to the lesser friction force existing between wall 45 at the constricted section of the stem and the wall bore 19 of the piston, effects relative movement of the plunger to the piston to thereby close the discharge ports 33 as the pump chamber volume continues to expand and draw product from the inlet passage to reprime the chamber as in the normal manner.

Figure 5:
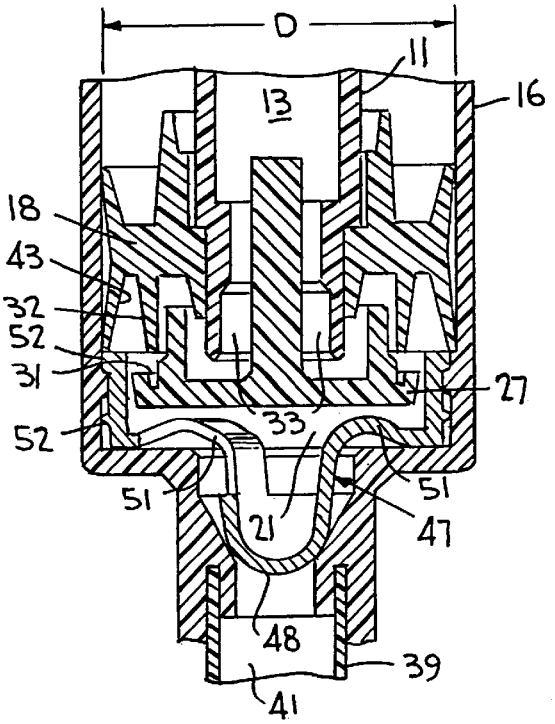
FIG. 5 is a view similar to FIG. 2 of another embodiment according to the invention showing the piston and stem at the end of the pressure stroke.

In accordance with another embodiment of the invention, shown in FIGS. 5 to 8, the inner diameter D of the pump cylinder is constant throughout its length and the inlet ball check valve is replaced by an inlet valve assembly 47 as having a part spherical portion 48 normally seated against a throat section 49 of inlet passage 41 as shown in FIG. 5 for valving inlet passage 41. Inlet valve assembly 47 further includes an upstanding annular wall 49 integrally connected with portion 48 via a plurality (such as two, or three or more) spring legs 51. Wall 49 may have outer protrusions 52 axially spaced apart to establish a range of movement of wall 49 relative to a protrusion 53 provided on the inner wall of the pump cylinder.

In operation, at the end of the plunger downstroke piston seal 43 bears against annular wall 49 of valve assembly 47 which lies in its path for thereby shifting wall 49 slightly downwardly which thereby deforms spring legs 51 effecting a tight seal between part-spherical portion 48 and its valve seat. Thus, in a plunger lock-down condition, as disclosed by the aforementioned related application, any leakage of product through the inlet passage is avoided during shipping and storage.

Figure 6:
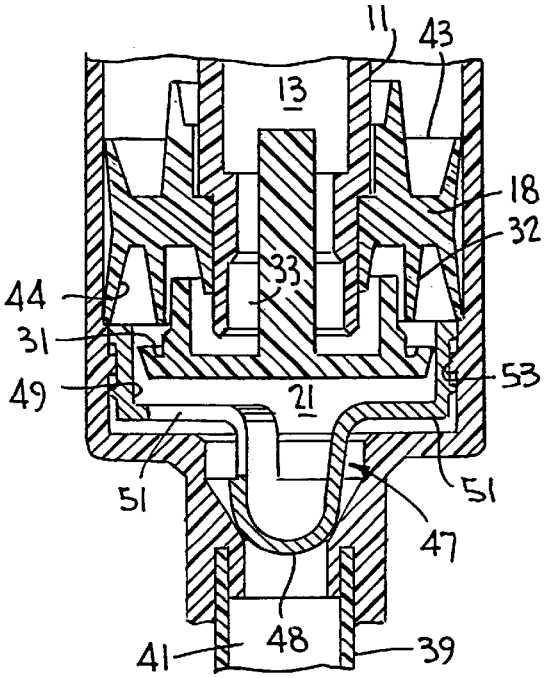
FIG. 6 is a view similar to FIG. 5 showing the piston and stem at the commencement of the upstroke.

At the commencement of the plunger return stroke, as shown in FIG. 6, the plunger stem commences its return by the restoring force of return spring 24 as in any normal manner. By the provision of valve assembly 47 as aforedescribed at the commencement of the return stroke, the restoring force of spring legs 51 shifts wall 49 upwardly which correspondingly shifts the piston upwardly together with stem movement, thus maintaining discharge ports 33 open, and retaining for a short interval an open communication between discharge passage 13 and the pump chamber as valve flange 32 remains unseated from groove 31. This open condition exists while the volume of the pump chamber expands to thereby retract product from the discharge passage into the pump chamber to remove any product droplet formation at the end of the spout, while at the same time releases spring 51 pressure against portion 48 which allows for the commencement of product to be suctioned into the pump chamber via the inlet passage.

Figure 7:
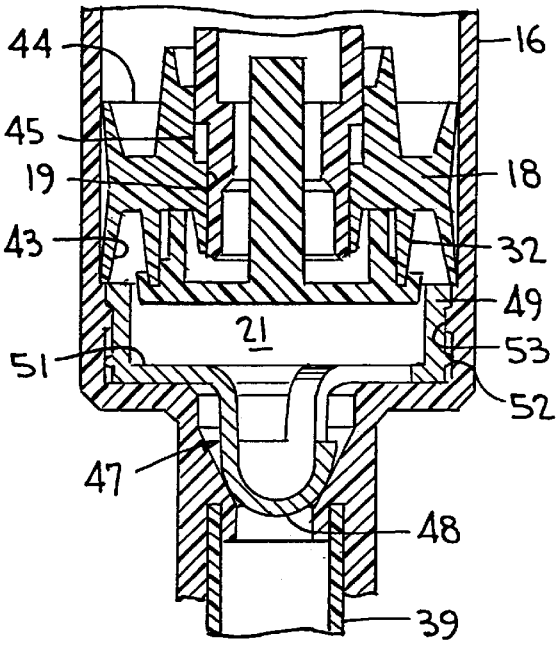
FIG. 7 is a view similar to FIG. 5 showing a discharge valve in closed condition after the commencement of the upstroke.
Figure 8:
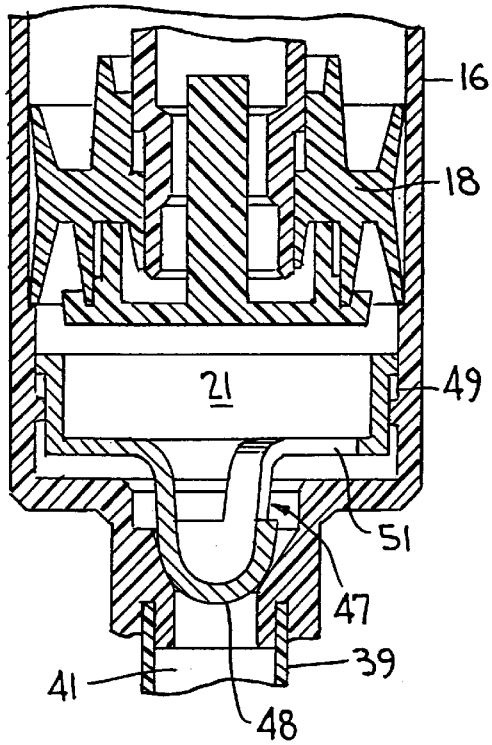
FIG. 8 is a view similar to FIG. 5 showing the piston and stem during upward travel after commencement of the upstroke.

Once spring legs 51 have recovered to their original shape, as shown in FIG. 7, the only force that would act on the piston is the one due to friction acting between piston seals 43, 44 and the inner wall of the pump cylinder. This friction force being greater than the friction force established between 45 and the wall of central bore 19 of the piston, permits the plunger stem at this stage to continue its upstroke movement relative to the piston whereupon the discharge is sealed closed as valve flange 32 again reseats within its annular groove 31. As the upstroke continues, the pump chamber further increases in volume from that of FIG. 7 to that of FIG. 8, such that it releases spring 51 pressure against part-spherical valve portion 48 which permits product to be inletted into the pump chamber via the inlet passage. Cooperation between protrusions 52 and 53 limits the movement of the valve and likewise retains the valve assembly in place during assembly of the parts of the dispenser.

From the foregoing it can be seen that a simple and economical yet highly effective approach has been taken to avoid the formation of product droplets at the end of each pressure stroke, which thereby avoids unslightly and messy conditions and minimizes contact between product and the outside air at the spout end which could cause clogging.

Obviously many other modifications and variations of the present invention are made possible in the light of the above teachings. It is therefore to be understood that within the scope of the appended claims the invention may be practiced otherwise than as specifically described.

What is claimed is:

1. A fluid pump dispenser comprising, a piston on one end of a hollow stem manually reciprocable between pressure and return strokes within a pump cylinder defining a variable volume pump chamber for dispensing liquid product through a discharge channel at the other end of the stem, a valve controlled inlet passage leading to said chamber, said piston being mounted on said one end for relative sliding movement during manual reciprocation, said stem defining a discharge passage leading from said chamber, means acting between said stem and said piston for limiting the relative sliding movement between discharge open and closed positions, a valve element on said one end of said stem sealingly engaging said piston in the discharge closed position, first engaging surfaces acting between said one end and said piston establishing a first friction force, and second engaging surfaces acting between said piston and said cylinder establishing a second friction force, said first friction force exceeding said second friction force at the commencement of the return strokes causing said piston to shift with said stem to expand the pump chamber in the discharge open position for retracting product from said discharge passage and said spout into said pump chamber to avoid dribbling of product from said spout.

2. The dispenser according to claim 1, wherein one section of said pump cylinder defining one of said second engaging surfaces has an inner diameter of a predetermined size greater than the inner diameter of a remaining section of said cylinder.

3. A fluid pump dispenser comprising, an elongated reciprocable, hollow piston stem defining a discharge passages having a discharge opening at an outer end and a valve element at an inner end, a hollow piston mounted on a constricted section of said piston stem at said inner end for relative sliding movement between a discharge open position and a discharge closed position at which said valve element sealingly engages said piston, said piston being reciprocable within a pump cylinder to therewith define a variable volume pump chamber, said hollow piston having a central bore having a surface engaging said constricted section to define a first friction force, said piston having an annular piston seal in engagement with an inner surface section at an inner end of said cylinder to define a second friction force, said first friction force exceeding said second friction force such that said piston will be caused to shift with said stem to increase the volume of said pump chamber in said discharge open position, whereby product is retracted from said discharge passage and said discharge opening into said chamber to avoid any dribbling of product from said opening.

4. The dispenser according to claim 3, wherein said inner surface section has a diameter of a predetermined size greater than the inner diameter of a remaining section of said cylinder.

5. A fluid dispenser comprising, a hollow piston at one end of a hollow stem reciprocable between pressure and return strokes within a pump cylinder to therewith define a variable volume pump chamber, said piston being mounted on a constricted section of said stem for relative reciprocation between an open discharge position through said stem and a closed discharge position in which said piston is sealed against a valve element on said one end of said stem, an inlet passage leading to said chamber controlled by an inlet valve assembly having restoring spring means biased in the direction of reciprocation and located at a bottom wall of said cylinder in the path of reciprocation of said piston, said spring means being compressed by said piston at the end of said pressure strokes for shifting said piston away from said bottom wall at the commencement of said return strokes to increase the volume of said pump chamber in said discharge open position, whereby product is retracted from a discharge passage defined by said hollow stem and from a discharge opening at the end of said passage to avoid any dribbling of product from said opening.

6. The dispenser according to claim 5, wherein said spring means comprise at least an opposing pair of spring legs lying along an inner wall of said cylinder.

7. The dispenser according to claim 5, wherein said inlet valve comprises a part-spherical portion formed integrally with said spring means.

8. The dispenser according to claim 6, wherein said inlet valve comprises a part-spherical portion formed integrally with said spring legs.

9. The dispenser according to claim 5, wherein said spring means engages means provided on said cylinder for retaining said spring means at said bottom wall of said cylinder.

10. The dispenser according to claim 6, wherein said spring legs engage means provided on said cylinder for retaining said spring means at said bottom wall of said cylinder.

* * * * *